United States Patent [19]

Wilson

[11] Patent Number: 4,584,724

[45] Date of Patent: Apr. 29, 1986

[54] TOILET SEAT LIFTING AND LOWERING DEVICE

[76] Inventor: Patricia Z. Wilson, 1291 Ashland Dr., Baton Rouge, La. 70806

[21] Appl. No.: 737,530

[22] Filed: May 24, 1985

[51] Int. Cl.[4] ..... A47K 13/10

[52] U.S. Cl. ..... 4/251

[58] Field of Search ..... 4/251

[56] References Cited

U.S. PATENT DOCUMENTS

| | | | |
|---|---|---|---|
| 1,511,533 | 10/1924 | Staszak | 4/251 |
| 1,792,811 | 2/1931 | Bustin | 4/251 |
| 1,856,159 | 5/1932 | Grillo et al. | 4/251 |
| 2,011,404 | 8/1935 | Giliasso | 4/251 |
| 2,155,548 | 4/1939 | Hompesch | 4/251 |
| 2,723,400 | 11/1955 | Wilson | 4/251 |
| 2,954,565 | 10/1960 | Millier | 4/251 |
| 3,055,016 | 9/1962 | Kemp | 4/251 |
| 3,504,385 | 4/1970 | Fields | 4/251 |
| 3,516,095 | 6/1970 | Clifton et al. | 4/251 |
| 4,030,146 | 6/1977 | Pilkington et al. | 4/251 |

*Primary Examiner*—Charles E. Phillips

[57] ABSTRACT

A toilet seat lifting and lowering device composed of a self supported moveable base, a foot pedal mounted on the base, an upright rod hinged to the foot pedal on one end and hinged at the top to a lift arm that extends all the way across the back underside of a toilet seat and is secured to same. A hand operated attachment consisting of a vertically mounted rod secured to the toe of the foot pedal and braced with a rod that is secured to the heel part of the foot pedal which can be utilized to make the toilet seat lifting and lowering device hand operable. The foot pedal pivots so that pressure on the heel part of the foot pedal raises the upright rod which simultaneously raises the lift arm and the toilet seat. The foot pedal and supporting base can be positioned so that when the toilet seat reaches the upright position it will remain upright when the user's foot is removed from the foot pedal. By utilizing a complete foot pedal, the user can lower the toilet seat by pressure on the toe section of the foot pedal to pull the upright rod, lift arm and toilet seat down in a controlled movement.

1 Claim, 4 Drawing Figures

TOILET SEAT LIFTING AND LOWERING DEVICE

BACKGROUND OF THE INVENTION

This invention is an improvement over prior inventions, such as U.S. Pat. No. 1,999,070 to Svedelius and U.S. Pat. No. 3,504,385 to Fields. Each invention requires either attachment to the base of a toilet, which varies in size and location, or attachment to the floor which is difficult and expensive.

On the Svedelius invention, a foot pedal is used to lift a toilet seat, but when the user's foot is removed, the toilet seat falls. On the Field's invention, a foot pedal is also used to lift a toilet seat. The invention does not lift a toilet seat to a completely upright position, consequently, the user's foot must remain on the foot pedal to keep the toilet seat open. When the user's foot is removed, a hydraulic cylinder controls the lowering of the toilet seat.

SUMMARY OF THE INVENTION

It is the primary objective of this invention to provide a simple foot pedal operated lifting and lowering device that is workable on toilets of different sizes.

Another objective of this invention is to provide a complete foot pedal which enables the user to lift a toilet seat with heel pressure and lower the toilet seat with toe pressure in a controlled movment.

A still furthur objective of this invention is to utilize a self supporting base for the foot pedal that requires no attachment to either a toilet or floor, and can be positioned so that when the toilet seat reaches the upright position, it will remain upright when the user's foot is removed.

An additional objective of this invention is to locate the rotation of the lift arm and upright rod of the toilet seat lifting device out to the side, away from the toilet seat, so that the stress is reduced on the actual lifting process thereby reducing the wear on the toilet seat.

Another important objective of this invention is to provide a hand operated attachment that can operate the foot pedal for the elderly or handicapped persons who could not use a foot pedal with normal foot pressure. This attachment is positioned at a height that does not require the user to bend forward, which many elderly and handicapped persons cannot do.

The final objective of this invention is to provide a durable, easy to clean, functional device that can eliminate the need for direct handling of a toilet seat at a time when new diseases are being discovered daily and many of these diseases are known to be spread by contact with human waste present on toilet seats. With the hand attachment, the device becomes useable for the elderly and handicapped who have an even greater need for improved sanitary conditions.

SUMMARY OF THE INVENTION

In general, this invention can be described as a toilet seat lifting and lowering device that utilizes a complete foot pedal pivotally mounted on a self supporting base that requires no attachment to either a toilet base or floor. This ability to position the foot pedal and base enables the user to uniquely adapt this device to his toilet seat.

The foot pedal pivots so that pressure on the heel part of the foot pedal raises the upright rod which simultaneously raises the lift arm and the toilet seat with a controlled movement.

The foot pedal and base can be positioned so that when the toilet seat reaches the upright position, it will remain in the upright position when the user's foot is removed.

The lift arm extends all the way across the back underside of a toilet seat and rotates on a hinge attached to the upright rod. By arranging the rotation of the lift arm away from the toilet seat, stress is reduced on the lifting process, thereby reducing wear on the lifting process.

A hand attachment connected to the foot pedal which enables the user to lift and lower a toilet seat with a hand operated controlled movement. The hand attachment is long enough to enable an adult to operate it without bending over.

By utilizing the above mentioned foot pedal type toilet seat lifting and lowering device, including the optional hand attachment when needed the direct handling of toilet seats can be eliminated. A much needed advancement toward dealing with human waste in a sanitary way can by accomplished.

BRIEF DESCRIPTION OF THE DRAWINGS

Referring to FIG. 1 a toilet 1 and is illustrated, positioned to it's right on the floor, is a base 3 for a foot pedal, which base is supported with rubber tabs 5 to keep it in position. The base 3 is designed with upright sides through which the fulcrum 11 is attached. A foot pedal lever 4 of appropriate size to accomodate an adult foot is attached so that it pivots on the fulcrum 11. One end of the foot pedal lever 4 is hinged at 7 to a rigid upright rod 6. The top of the rigid upright rod 6 is hinged at 7 to a rotating lift arm 8 making a right angle. The rotating lift arm 8 is to be secured to the back underside of a toilet seat 10, as is shown in FIG. 4. The hinge on the rotating lift arm 7 is shown in greater detail in FIG. 3.

Figure 1:
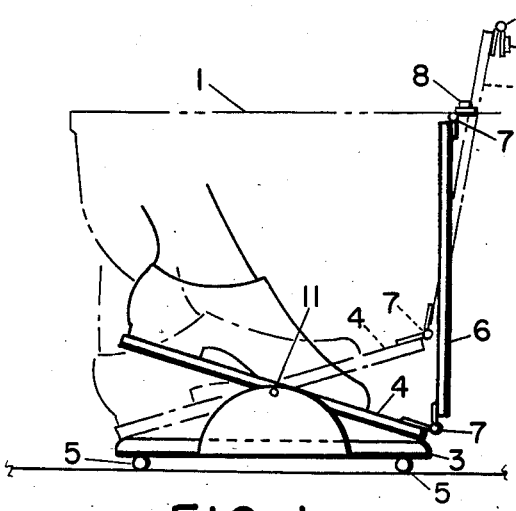
FIG. 1 is a side elevation of the toilet seat lifting and lowering device illustrating the lifting action with foot pressure.

In operation, the user's foot is positioned on the foot pedal lever 4. As the user pushes the heel part of the foot pedal lever 4 down, the hinged rigid upright rod 6 is pushed up, which simultaneously raises the lift arm 8 and toilet seat 2 in a controlled movement. The self supporting base 3 is positioned to each toilet uniquely, so that when the toilet seat reaches the upright position, it will remain upright when the user's foot is removed. When the user's foot pushes down on the toe part of the foot pedal lever 4, the hinged rigid upright rod 6 moves down which simultaneously pulls down the rotating lift arm 8 and the toilet seat 2 in a controlled lowering movement.

Figure 2:
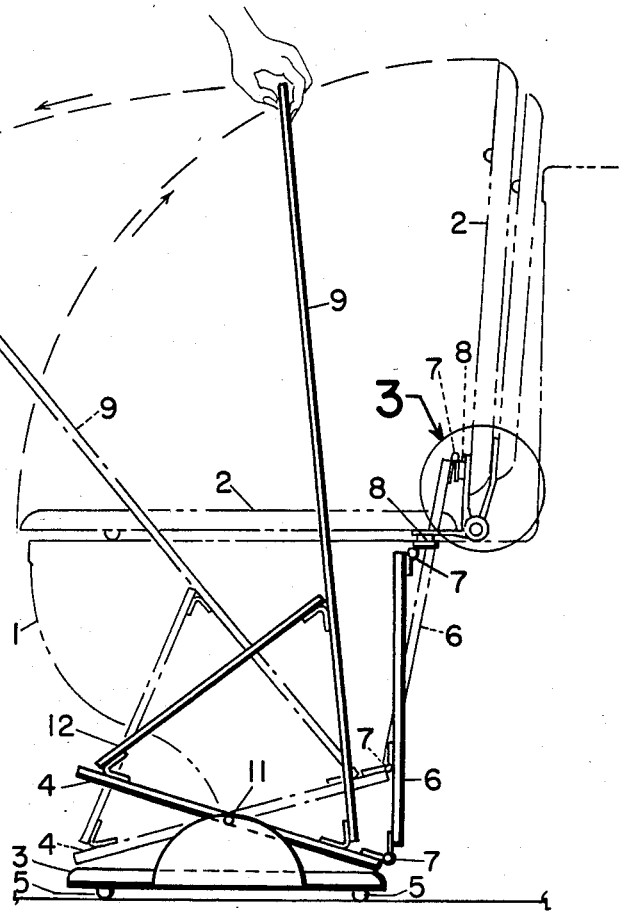
FIG. 2 is a side elevational view as shown in FIG. 1 illustrating the lifting and lowering action using a hand attachment connected to the foot pedal and the upright position of a toilet seat.
Figure 4:
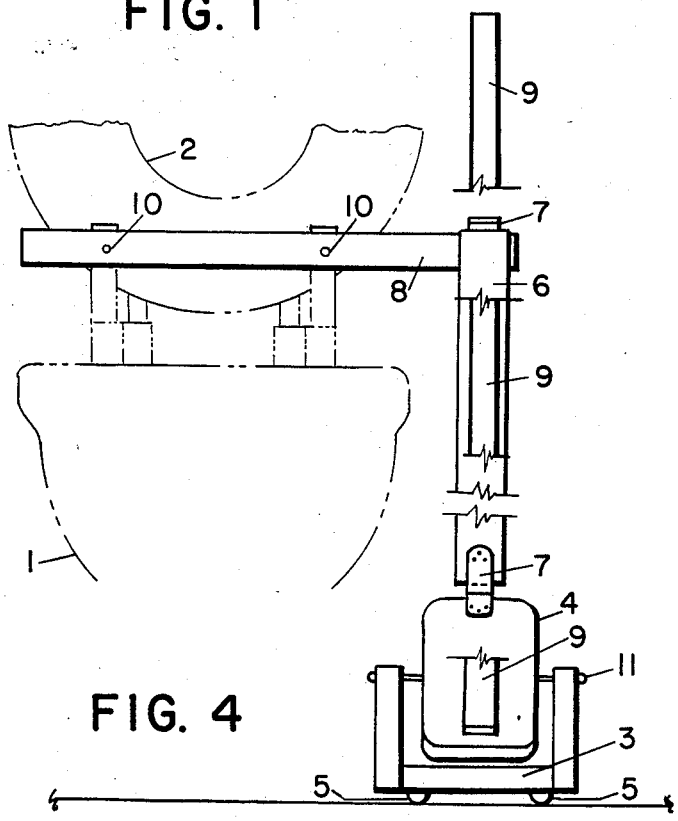
FIG. 4 is a front elevational view of the device attached to a toilet seat in an upright position. This view includes the hand attachment.
Figure 3:
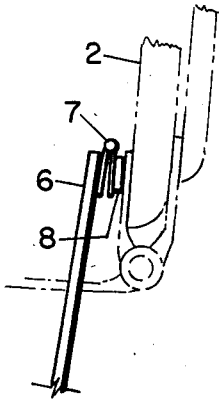
FIG. 3 is a partial side view of FIG. 2 detailing the hinged connection of the upright rod and lift arm.

A modified embodiment of the invention is presented in FIG. 2. In this embodiment, a vertically mounted rigid rod 9 is secured to to the toe part of the foot pedal lever 4 and braced with a rod 12 that is secured to the heel part of the foot pedal lever 4.

In operation, the toilet seat 2 in the lower position, FIG. 2 is lifted when the user pulls the hand operated vertically mounted rigid rod 9 forward which in turn causes the bracing rod 12 to push down the heel part of the foot pedal lever 4. The foot pedal lever 4 pivots on the fulfrum 11 to raise the upright rod 6 which simultaneously raises the rotating lift arm 8 and the attached toilet seat 2. The positioning of the base 3 in relation to the toilet 1 is to be adjusted so that when the user's hand is removed, the toilet seat 2 remains upright. When the user pushes the hand operated vertically mounted rigid rod 9 back, it pushes the toe part of the foot pedal lever 4 down, pulling down the rigid upright rod 6 which simultaneously pulls down the rotating lift arm 8 and the toilet seat 2 in a controlled movement.

It is shown in the illustrations provided in the drawings that this invention provides a simple foot pedal operated lifting and lowering device and because of the self supporting base can be uniquely positioned to fit toilets of various sizes. It's simple construction performs the versatile movements for which it was designed. The installation requires only a simple connection to a toilet seat.

What is claimed is:

1. A toilet seat lifting and lowering device for use with a conventional toilet bowl and seat arrangement, comprising; a base positionable on a floor to one side of said toilet bowl, said base including upstanding structure providing a fulcrum, a pedal pivotally mounted between a first and a second portion thereof to said base via said fulcrum, a rigid rod pivotally attached at one end to said second portion of said pedal, and at a second end to the under side of said toilet seat, a hand operated rod attached to said pedal on said second end portion of said fulcrum and extending upwardly a substantial distance above the level of said toilet seat, a bracing rod attached at one end to said hand operated rod and at the other end to said first portion of said pedal, wherein movement of said hand operated rod in a plane containing said hand operated rod and said rigid rod will cause said pedal to pivot about said fulcrum which will in turn cause said rigid rod to move said toilet seat from a raised to a lowered position or vice versa.

* * * * *